US007648308B2

(12) United States Patent
Cuny et al.

(10) Patent No.: US 7,648,308 B2
(45) Date of Patent: Jan. 19, 2010

(54) FRAME AND CORRESPONDING ROADWAY DEVICE

(75) Inventors: Arnaud Cuny, Domgermain (FR); Francis Berthon, Pompey (FR)

(73) Assignee: Saint-Gobain Pam, Nancy (FR)

( * ) Notice: Subject to any disclaimer, the term of this patent is extended or adjusted under 35 U.S.C. 154(b) by 35 days.

(21) Appl. No.: 11/679,984

(22) Filed: Feb. 28, 2007

(65) Prior Publication Data

US 2007/0227077 A1 Oct. 4, 2007

(51) Int. Cl.
*E02D 29/14* (2006.01)

(52) U.S. Cl. ..... 404/26

(58) Field of Classification Search ..... 404/25, 404/26

See application file for complete search history.

(56) References Cited

U.S. PATENT DOCUMENTS 5,090,713 A * 2/1992 Johnson ..... 277/648
5,318,376 A * 6/1994 Prescott, Sr. ..... 404/25
5,924,846 A * 7/1999 Arnold et al. ..... 417/36
6,035,581 A * 3/2000 McCoy ..... 52/20
6,161,984 A * 12/2000 Sinclair ..... 404/25
6,688,806 B2 * 2/2004 Kuan ..... 404/25
7,160,051 B1 * 1/2007 Cuny et al. ..... 404/25

FOREIGN PATENT DOCUMENTS

FR 2 376 919 A1 8/1978
FR 2 797 281 A1 2/2001

* cited by examiner

*Primary Examiner*—Gary S Hartmann
(74) *Attorney, Agent, or Firm*—Sughrue Mion, PLLC

(57) ABSTRACT

This frame (2) comprises a bottom plate (22) which has a base (26) which defines a frame support surface (28) which is directed towards an inner side (I) and a skirt (20) which is intended to receive a covering element (4) and which defines an outer side (E). The bottom plate (22) comprises at least one cell (32) which is open towards the inner side (I). Use in frames for manholes.

16 Claims, 4 Drawing Sheets

FRAME AND CORRESPONDING ROADWAY DEVICE

TECHNICAL FIELD

The present invention relates to a frame, in particular for a roadway device, of the type comprising a bottom plate which has, on the one hand, a base which defines a frame support surface which is directed towards an inner side in the assembled state and, on the other hand, a skirt which is intended to receive a covering element and which defines an outer side in the assembled state.

BACKGROUND TO THE INVENTION

Document FR-2 376 919, for example, discloses a manhole which comprises a frame which is intended to be fixed in the ground and a lockable cover which closes the frame. The frame comprises an annular flat bottom plate and a substantially cylindrical skirt.

The cross-section of the bottom plate is substantially identical over the entire circumference thereof and, consequently, the frame is only weakly anchored in the fixing material.

The object of the invention is to provide a frame for a roadway device, in particular for a manhole, which allows better anchoring in the fixing material.

SUMMARY OF THE INVENTION

To this end, the invention relates to a frame of the above-mentioned type, characterised in that the bottom plate comprises at least one cell which is open towards the inner side. According to specific embodiments, the frame according to the invention comprises one or more of the following features:

- the or each cell has a height which is greater than a thickness of the base, in particular at least two times greater than the thickness of the base;
- the or each cell forms a ridge which is directed towards the outer side;
- the or each cell has a cross-section in the form of a U, V or inverted arc;
- the frame comprises at least one strengthening rib which is adjacent to the ridge of a cell and which is directed towards the outer side;
- the or each strengthening rib has a shape which narrows towards the outer side;
- the or each cell comprises at least one through-hole, in particular in the direction which extends from the outer side towards the inner side; and
- the through-hole is arranged at the outermost portion of the cell.

The invention further relates to a roadway device, of the type comprising a frame and a covering element, characterised in that the frame is a frame as defined above.

BRIEF DESCRIPTION OF DRAWINGS

The invention will be better understood from a reading of the following description, given with reference to the appended drawings, in which.

DESCRIPTION OF PREFERRED EMBODIMENT

Figure 1:
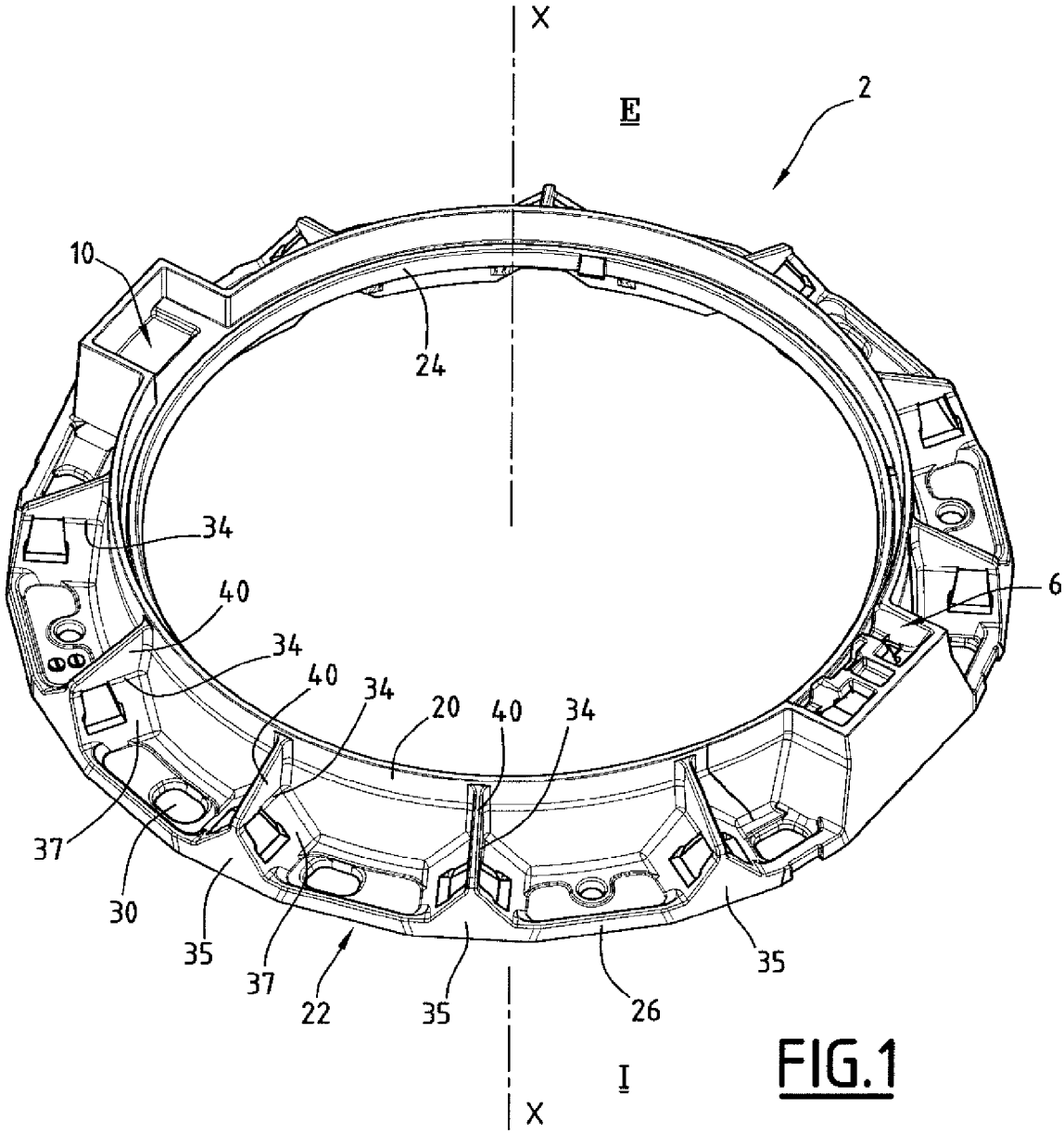
FIG. 1 is a perspective view of the outer side or the top of a frame according to the invention.
Figure 2:
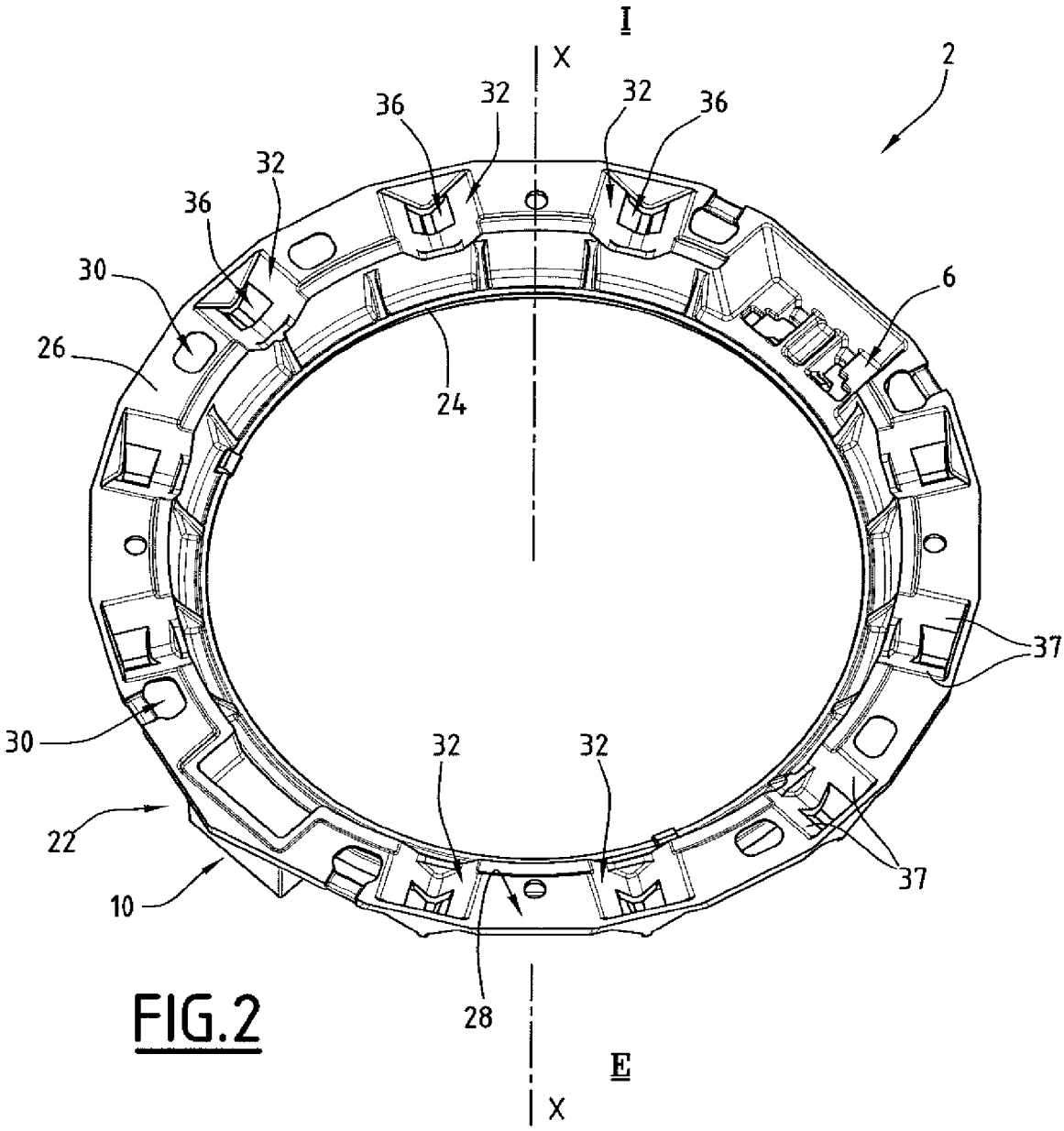
FIG. 2 is a perspective view of the inner side or bottom of the frame of FIG. 1.
Figure 5:
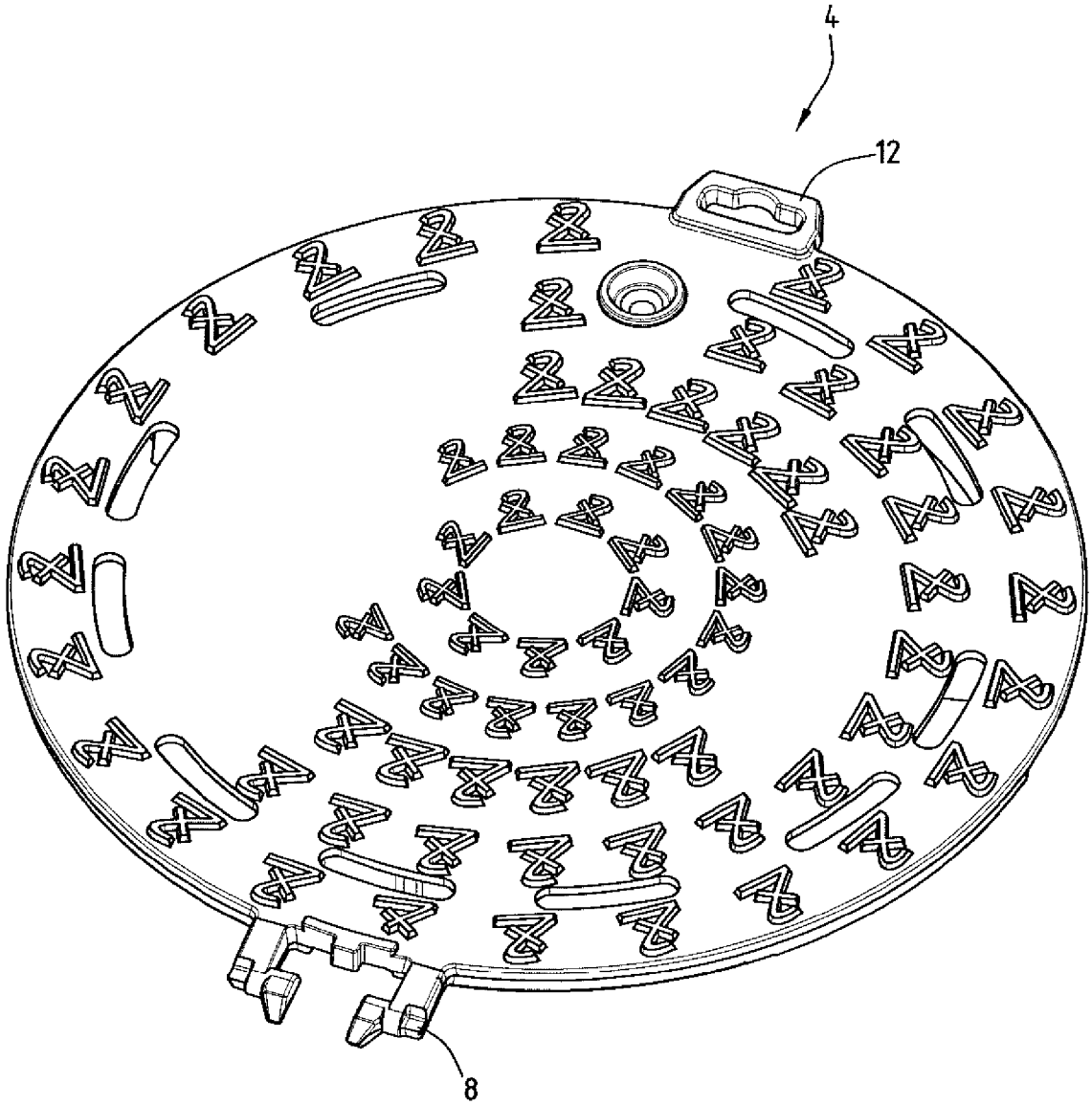
FIG. 5 is a perspective view of a cover, forming a manhole with the frame of FIGS. 1 to 3.

FIG. 1 illustrates a frame according to the invention, generally designated 2. The frame 2 serves to support a closing cover 4, such as that illustrated in FIG. 5, the assembly forming a manhole. The frame 2 and the cover 4 are preferably produced from ductile cast iron.

The frame 2 defines a centre axis X-X and has a shape which is generally annular about this axis X-X. In the following, the expressions "axially", "radially", and "circumferentially" will be used in relation to this axis X-X.

The frame 2 comprises a hinge knuckle 6 which co-operates with a complementary hinge knuckle 8 which is fixedly joined to the cover 4, allowing the cover 4 to be opened and closed by means of rotation about the frame.

The frame 2 is further provided with a housing 10 which protrudes radially in a region which is diametrically opposed to the hinge knuckle 6 of the frame. This housing 10 is suitable for receiving a handling element 12 which protrudes radially at the periphery of the cover 4 when the cover is in a closed position on the frame.

The frame 2 comprises a skirt 20 and a bottom plate 22. The skirt 20 defines an outer side E which, in the case of a manhole, is directed upwards. The skirt 20 has a substantially cylindrical shape about the axis X-X. In this instance, viewed along the axis X-X, the skirt 20 is substantially circular. Furthermore, the skirt 20 comprises a radially inner lip 24 which receives a sound deadening ring (not illustrated) on which the cover 4 rests in a closed position.

The bottom plate 22 extends, from the inner end of the skirt 20, radially outwards relative to the axis X-X.

The bottom plate 22 has a base 26 which defines a support surface 28. The base 26 has a thickness d, measured along the centre axis X-X. The support surface 28 is substantially planar and extends perpendicularly relative to the axis X-X. This support surface 28 is directed in the assembled state towards an inner side I (see FIG. 4). In the case of a manhole, the support surface 28 is directed downwards in the assembled state.

The base 26 comprises axial through-holes 30 for anchoring the base 26 in a fixing material.

The bottom plate 22 is further provided with a plurality of cells 32 which are open towards the inner side I. Each cell 32 has an axial height D, or axial depth, which is greater than the thickness d of the base 26, and which is preferably greater than two times the thickness d of the base 26.

Figure 4:
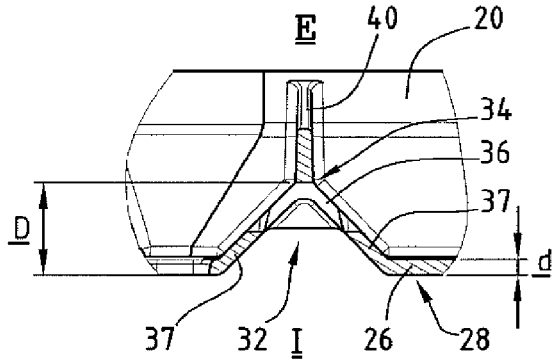
FIG. 4 is an enlarged section, taken along line IV-IV, of FIG. 3.

As can be seen in FIG. 4, each cell 32 has a profile having a tangential cross-section, that is to say, when viewed radially, in the form of an inverted V, the tip being directed away from the outer side E. Each cell 32 thus has two inclined walls 37 which extend from the base 26 and which merge to form a ridge 34 which is directed towards the outer side E. As can be seen in FIG. 1, each ridge 34 extends in a radial direction.

In a variant, the tangential cross-section of the cells may be of another shape, in particular in the form of a U or inverted arc.

Furthermore, the radially outer side of the cell 32 is closed by a wall 35. In a variant, this wall 35 may be openwork.

Figure 3:
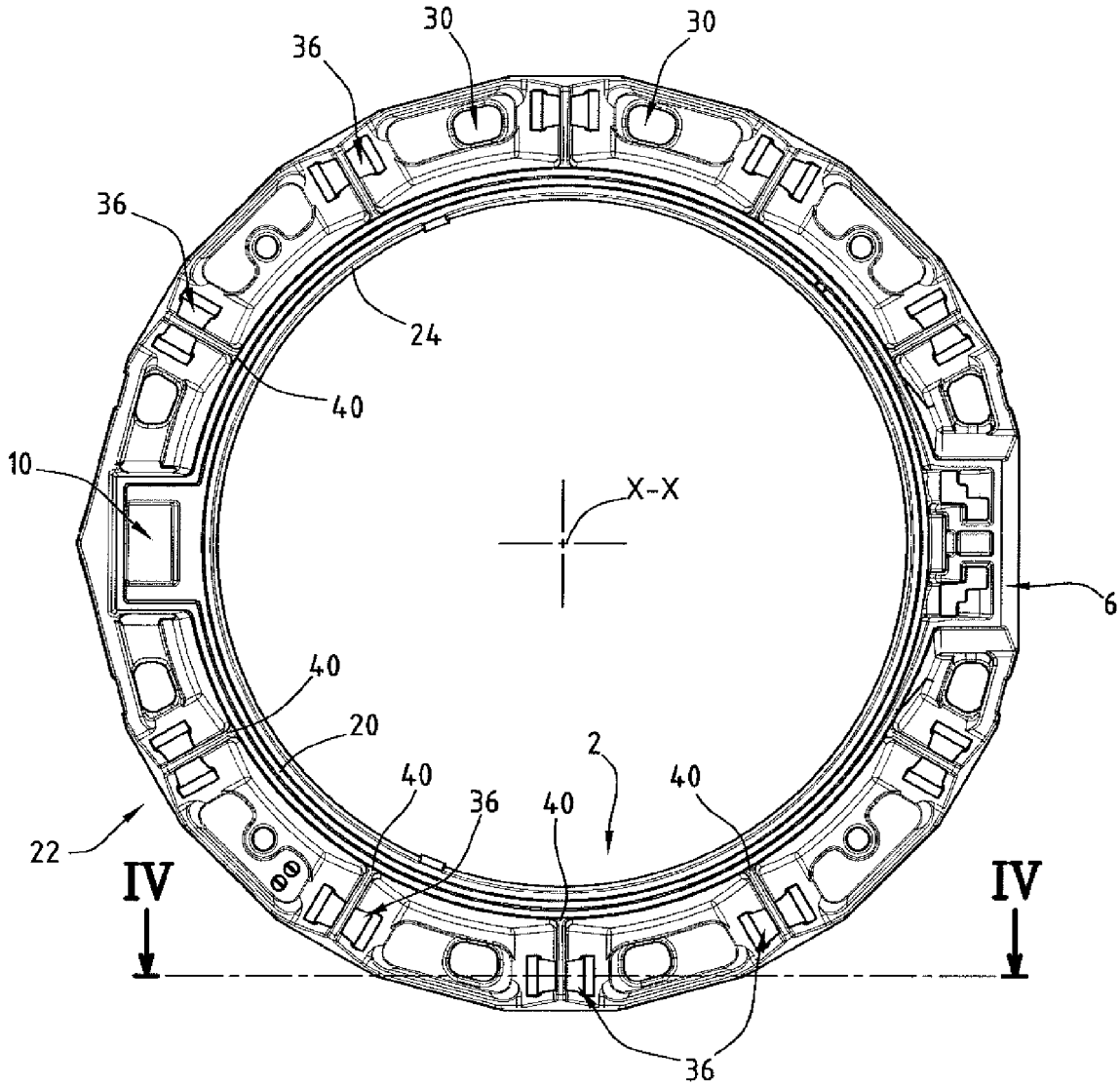
FIG. 3 is a plan view of the top of the frame according to the invention.

In the inclined walls 37 of each cell 32, there is provided an axial through-hole 36 which is arranged at the outermost portion of the cell 32. When viewed axially (see FIG. 3), the through-hole 36 has a substantially rectangular shape and extends at one side and the other of the ridge 34. These through-holes 36 facilitate the diffusion of the fixing material of the cells 32 towards the outer side, which has the effect of optimising the coverage of the bottom plate 22 in the fixing material and thus improving the anchoring of the frame 2.

The through-holes 36, in the outer portion of the cells, also prevent the trapping of air bubbles which are capable of impairing the penetration of the fixing material in the cells. Furthermore, these holes 36 also form gripping holes for the frame.

The frame 2 also comprises strengthening ribs 40 which are adjacent to the ridge 34 of each cell 32. Each rib 40 extends from the associated ridge 34 at the outer side E and narrows towards the outer edge of the skirt 20. In this instance, the rib 40 is in the form of a right-angled triangle.

The cells 32 on the one hand increase the strength of the frame 2 and, on the other hand, allow better anchoring of the frame in the fixing material.

The cells 32 thus increase the contact surface-area between the frame, which is generally of cast iron, and the fixing material, which is generally constituted by concrete or cement mortar, thus allowing the contact pressure of the frame to be reduced on the fixing material or on the underground structure on which the manhole is supported, more particularly when the manhole is subjected to significant forces resulting from road traffic on the surface.

When a vehicle brakes or changes direction on the cover, the cells 32 also allow the shearing forces of the fixing material to be reduced owing to its presence in the cells, thus improving the anchoring of the frame.

It should also be noted that the cells 32 according to the invention are raised relative to the general plane of the base 26 of the bottom plate and thus allow a spatial interaction with the fixing material, consequently ensuring better anchoring.

It should be noted that the invention may be used for devices other than manholes, and in particular on any roadway device which comprises a frame which must be fixed in a fixing material and a covering element of the cover or grill type which is supported on the frame.

The invention claimed is:

1. Frame for a roadway device, comprising a bottom plate which has a base which defines a frame support surface which is directed towards an inner side in an assembled state, and also has a skirt which is intended to receive a covering element and which defines an outer side in the assembled state, wherein the bottom plate comprises at least one cell which is open towards the inner side, said at least one cell comprising at least one through-hole.

2. Frame according to claim 1, wherein the or each cell has a height which is greater than a thickness of the base.

3. Frame according to claim 1, wherein the or each cell forms a ridge which is directed towards the outer side.

4. Frame according to claim 2, wherein the or each cell forms a ridge which is directed towards the outer side.

5. Frame according to claim 3, wherein the or each cell has a cross-section in the form of a U, V or inverted arc.

6. Frame according to claim 4, wherein the or each cell has a cross-section in the form of a U, V or inverted arc.

7. Frame according to claim 3, comprising at least one strengthening rib which is adjacent to the ridge of a cell and which is directed towards the outer side.

8. Frame according to claim 5, comprising at least one strengthening rib which is adjacent to the ridge of a cell and which is directed towards the outer side.

9. Frame according to claim 7, wherein the or each strengthening rib has a shape which narrows towards the outer side.

10. Frame according to claim 8, wherein the or each strengthening rib has a shape which narrows towards the outer side.

11. Frame according to claim 1, wherein the at least one through-hole has a direction which extends from the outer side towards the inner side.

12. Frame according to claim 11, wherein the through-hole is arranged at the outermost portion of the cell.

13. The frame according to claim 2, wherein said height is at least two times greater than the thickness of the base.

14. The frame according to claim 1, wherein the cell is filled with mixing material comprising cement or cement mortar.

15. Roadway device comprising a frame and a covering element, wherein the frame comprises a bottom plate which has a base which defines a frame support surface which is directed towards an inner side in an assembled state, and also has a skirt which is intended to receive a covering element and which defines an outer side in the assembled state, wherein the bottom plate comprises at least one cell which is open towards the inner side, said at least one cell comprising at least one through-hole.

16. The device according to claim 15, wherein the cell is filled with mixing material comprising cement or cement mortar.

* * * * *